US005989000A

United States Patent [19]

Tomayko et al.

[11] Patent Number: 5,989,000

[45] Date of Patent: Nov. 23, 1999

[54] SCROLL COMPRESSOR WITH BACK PRESSURE HOLE RELIEF

[75] Inventors: Edward A. Tomayko; Carlos A. Zamudio, both of Arkadelphia, Ark.

[73] Assignee: Scroll Technologies

[21] Appl. No.: 08/908,501

[22] Filed: Aug. 7, 1997

[51] Int. Cl.[6] ..... F04C 18/04

[52] U.S. Cl. ..... 418/55.5; 418/57

[58] Field of Search ..... 418/55.5, 57

[56] References Cited

U.S. PATENT DOCUMENTS

| | | | |
|---|---|---|---|
| 5,256,044 | 10/1993 | Nieter et al. | 418/55.5 |
| 5,447,420 | 9/1995 | Caillat et al. | 418/55.5 |
| 5,462,419 | 10/1995 | Hill et al. | 418/55.4 |
| 5,478,219 | 12/1995 | Nardone et al. | 418/55.5 |
| 5,588,820 | 12/1996 | Hill et al. | 418/55.5 |
| 5,607,288 | 3/1997 | Wallis et al. | 417/310 |

FOREIGN PATENT DOCUMENTS

| | | | |
|---|---|---|---|
| 63-106388 | 5/1988 | Japan | 418/55.5 |

*Primary Examiner*—John J. Vrablik
*Attorney, Agent, or Firm*—Howard & Howard

[57] ABSTRACT

A scroll compressor has a recess communicating with a back pressure hole leading to a back pressure chamber. The recess may be formed in either the rear face of the orbiting scroll, or in the mating face of the crankcase. Preferably, the recess surrounds the orbiting axis of the orbiting scroll compressor, and may be circular. The recess serves to quickly supply fluid from the back pressure hole to the back pressure chamber. This is particularly valuable at startup of the scroll compressor. With the inventive recess, a test to determine whether the scroll compressor is capable of reaching its operative pressures may be performed more quickly and more accurately. The recess is preferably relatively shallow, and is preferably of a depth which is less than the diameter of the back pressure hole.

19 Claims, 4 Drawing Sheets

SCROLL COMPRESSOR WITH BACK PRESSURE HOLE RELIEF

BACKGROUND OF THE INVENTION

This invention relates to improvements in the back pressure hole for a scroll compressor.

Scroll compressors are becoming widely utilized in many compression applications. A scroll compressor typically includes fixed and orbiting scrolls having generally spiral wraps that interfit to define moving compression chambers.

Fluid pressure due to the compressed gas tends to force the orbiting scroll away from the fixed scroll. The prior art has tapped pressurized fluid to a chamber behind the orbiting scroll to create a force to bias the orbiting scroll back against the fixed scroll. In the prior art, the back pressure tap has typically utilized a series of interconnected small passages to tap fluid from a compression chamber through a crossing passage, through a back pressure hole and into a back pressure chamber behind the orbiting scroll. The passages have typically been formed by drilling or boring the passages into the orbiting scroll.

Drilling the back pressure hole has resulted in burrs at the end of the passage which extends through the rear of the orbiting scroll. To provide proper operation it is important that a rear face of the orbiting scroll be as smooth as possible. Thus, the provision of the back pressure hole through the rear of the orbiting scroll face has required a separate finishing operation to remove the burrs. It would be desirable to minimize the necessary manufacturing steps for manufacturing a scroll compressor, including eliminating this separate step.

In addition, scroll compressors are typically tested upon assembly to ensure they can reach a particular pressure within a particular period of time. This final test is one designed to ensure that the scroll compressor has been properly manufactured and is properly sealing the compression chambers. If the scroll compressor does not achieve the desired pressure within a particular period of time it is deemed to be unacceptable, and is identified as scrap. In the past, otherwise acceptable scroll compressors have sometimes been identified as unacceptable with this test.

A problem with this test, and a problem with scroll compressor operation in general, is that the back pressure hole has tended to be a single small hole extending through the rear of the orbiting scroll face. The hole may be closed by the crankcase upon start up, until pressure develops within the compression chamber to bias the orbiting scroll away from the crankcase. At that point, pressure from the hole forces the orbiting scroll away from the crankcase.

In addition, there is a condition known as "start-up wobble" wherein the orbiting scroll wobbles when initially started. This is believed to be a combined factor of the forces which are normally opposed by the back pressure developing more quickly than the back pressure in the back pressure chamber does, and further partially due to the back pressure hole being closed off.

Thus, there have been some undesirable features with the prior art back pressure fluid supply.

SUMMARY OF THE INVENTION

In disclosed embodiments of this invention, the back pressure hole communicates fluid to a recess having a relatively large cross-sectional area. The recess eliminates the prior art problem of the hole being closed at startup, and ensures that the fluid from the back pressure hole is quickly and evenly delivered to the back pressure chamber upon startup of the scroll compressor significantly reducing transient effects like start-up wobble.

In one embodiment of this invention, the recess is formed in the rear face of the orbiting scroll, and thus eliminates the need for a separate deburring step for the hole. In other embodiments the recess is formed in a face of the crankcase facing the orbiting scroll rear face.

The recess preferably surrounds the rotational axis of the scroll compressor, and in a more preferred embodiment is generally circular. In this way, the pressurized fluid is quickly delivered around the circumference of the orbiting scroll member.

In a most preferred embodiment the depth of the recess is relatively small. In one embodiment the recess was less than 0.5 mm in depth. The depth is also preferably less than the diameter of the back pressure hole which communicates with the recess. In one embodiment the diameter of the hole was 1 mm and the depth of the recess was less than 0.2 mm. Preferably, the recess has a generally flat central portion with angled sides going to each side of the recess. The angles are preferably relatively small, and in one embodiment were less than 15°.

The embodiments having the recess in the crankcase have different design concerns that effect the dimension and shape of the recess.

These and other features of the present invention can be best understood from the following specification and drawings, of which the following is a brief description.

DETAILED DESCRIPTION OF A PREFERRED EMBODIMENT

Figure 1:
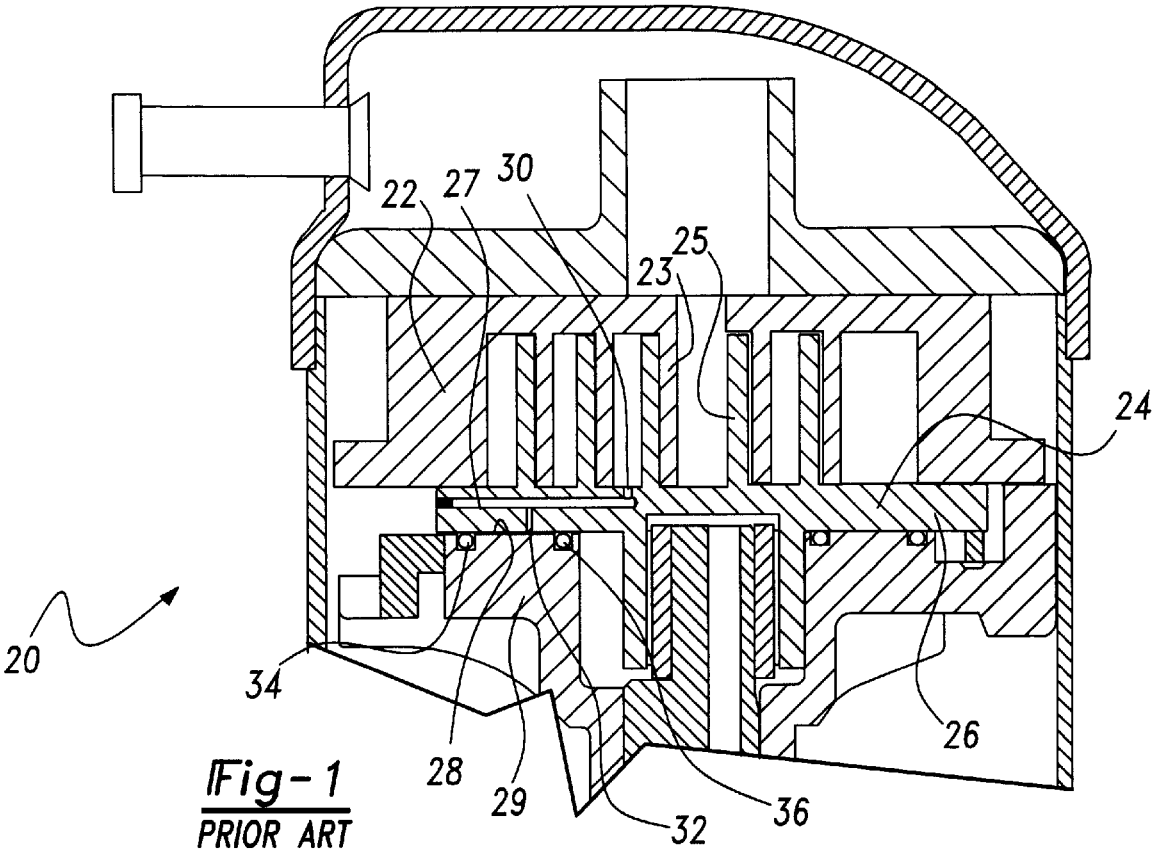
Fig-1 PRIOR ART
FIG. 1 shows a prior art scroll compressor.

FIG. 1 shows a prior art scroll compressor 20, including a fixed, non-orbiting scroll member 22 having a base and a spiral wrap 23 extending from the base. An orbiting scroll 24 has a wrap 25 interfitting with wrap 23. An orbiting scroll base 26 includes a back pressure passage 27 extending to a back pressure chamber 28 defined between a rear face of base 26 and a crankcase 29. A supply tap 30 communicates pressurized fluid from a compression chamber into passage 27 and then to a back pressure hole 32 which extends to the back pressure chamber 28. Back pressure chamber 28 is defined between seals 34 and 36 in crankcase 29.

In this prior art structure, the back pressure chamber biases the orbiting scroll 24 upwardly toward the fixed scroll 22 in opposition to the force from the gas being compressed within the compression chambers between the fixed and orbiting scroll members.

Figure 2:
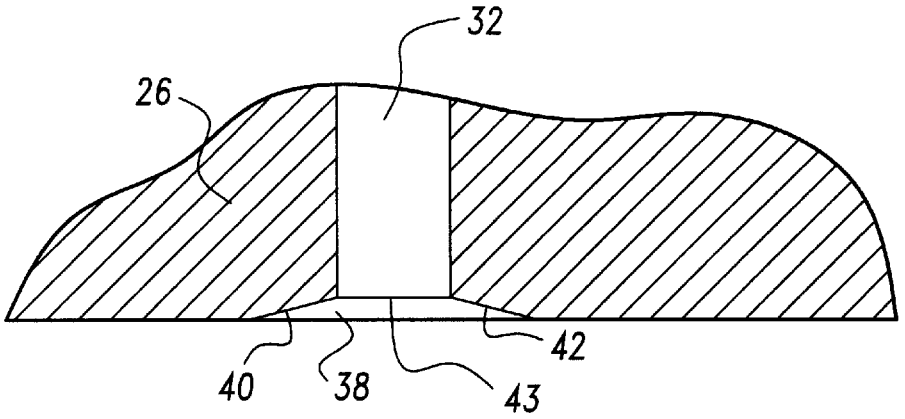
FIG. 2 is an enlarged view of a first embodiment of the present invention.

FIG. 2 shows an embodiment of the present invention which improves upon the back pressure supply of the prior art FIG. 1. As shown in FIG. 2, the back pressure hole 32 leads to recess 38. Recess 38 has two angled sides 40 and 42. At locations other than those aligned with hole 32 there is also a central recess portion 43. The depth of the recess 38 is less than the diameter of hole 32. Recess 38 preferably surrounds the central axis of the scroll compressor, and assists in the supply of back pressure fluid to back pressure chamber 28. Preferably, the depth of recess 38 is less than 0.5 mm in a scroll compressor having a diameter of 1.0 mm for the hole 32. In one embodiment the depth of recess 38 was approximately 0.2 mm. In this embodiment the angled sides 40 and 42 were at a relatively small angle, and in particular 15°.

Figure 3:
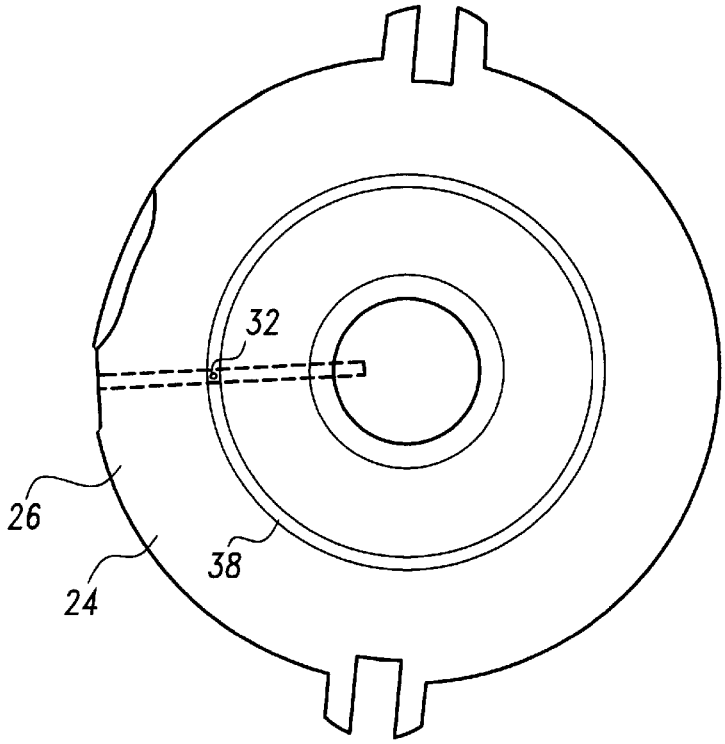
FIG. 3 is a rear view of the orbiting scroll of the FIG. 2 embodiment.

As shown in FIG. 3, recess 38 surrounds the axis of the orbiting scroll and is generally circular. Only one hole 32 is included in this embodiment. As can be appreciated from FIGS. 2 and 3, due to the angled sides 40 and 42, the recess has a side-to-side dimension greater than the diameter of hole 32. The recess thus quickly supplies fluid pressure to back pressure chamber 28. The present invention eliminates or greatly reduces the problem of hole 32 being blocked at startup. In addition, this embodiment eliminates the need for deburring hole 32.

Figure 4:
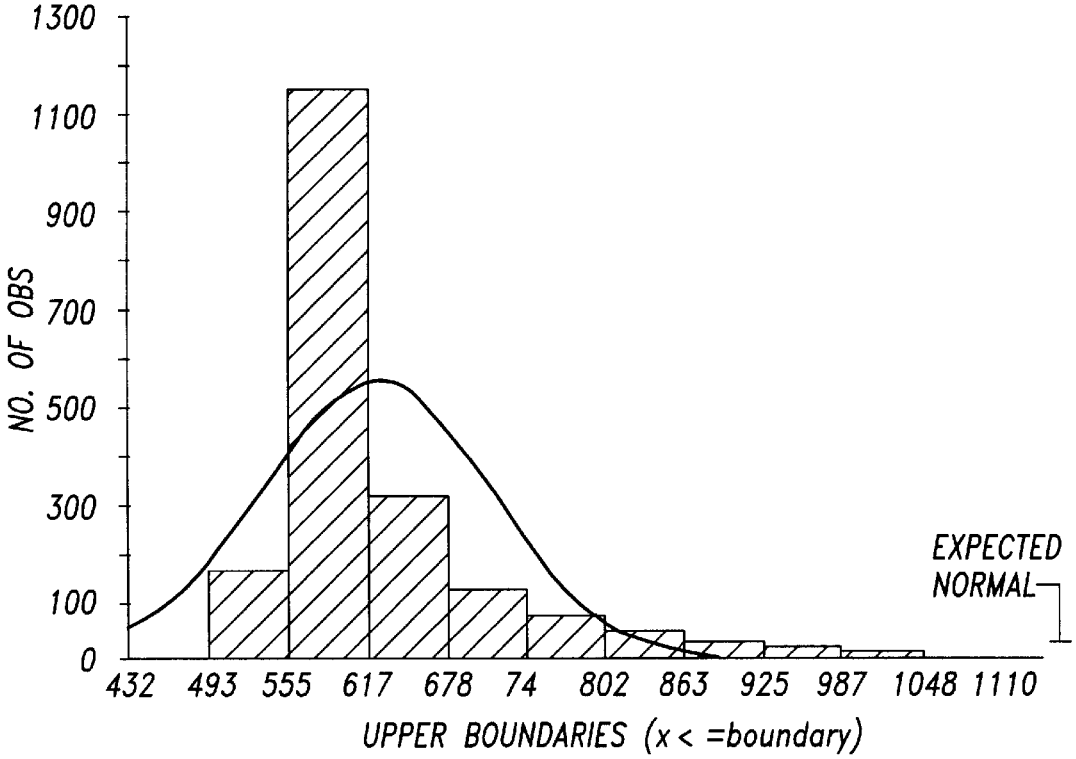
Fig-4 Prior Art
FIG. 4 is a graphic view of a startup test on the prior art compressor.

FIG. 4 is a graphic illustration of a startup test utilized on completed compressors of the prior art. The graph plots the number of observations of a test sample of production scroll compressors versus the time it took for the scroll compressor to reach a particular design pressure. In the instant case, the design pressure was 100 psi. The time is the number of seconds times 100. These compressors are tested automatically on an assembly line, and the reduction of a few seconds in the time required for the test would be a significant production improvement.

As shown, the actual compressors tested with the prior art structure had a relatively high number of units falling over a wide range between 493 and 1048. Thus, to ensure that these compressors would have adequate time to reach their test pressure, the prior art compressor needed to allow at least 10.5 seconds. It would be desirable to reduce this time to increase the speed of the testing portion of the compressor line. When compressors fall outside the expected normal, they are identified as being scrap or defective. That is, if it takes the compressor an undue amount of time to reach a particular pressure, then a decision is made that the sealing or other structure of that compressor is inadequate. As can be appreciated from FIG. 4, with the relatively wide bell curve, there are compressors that might otherwise be capable of reaching the pressure, but which fall outside of the bell curve, and are identified as scrap. It is, of course, undesirable to identify a compressor as scrap if it does operate properly.

Figure 5:
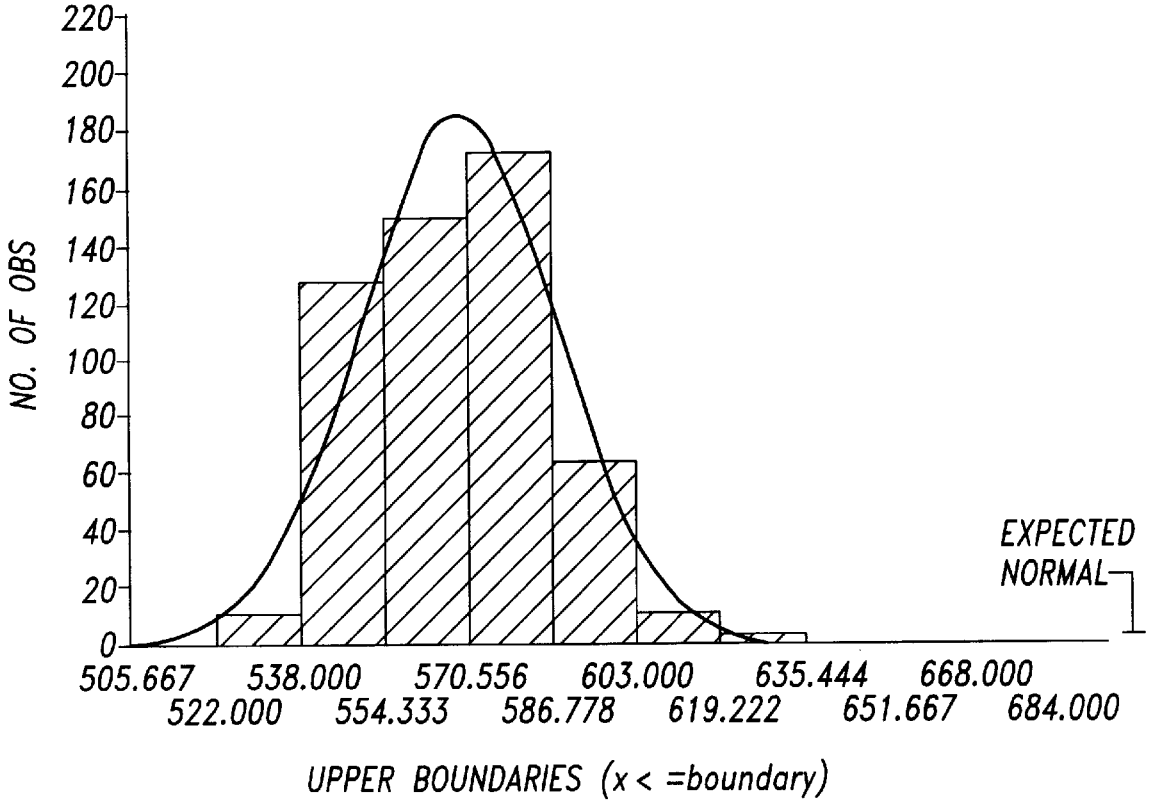
FIG. 5 is a graphic view of the results of a startup test on the scroll compressor including the inventive embodiment of FIGS. 2 and 3.

FIG. 5 shows a graph similar to FIG. 4, but showing test results of compressors according to FIGS. 2 and 3 of the present invention. As shown, the distribution is much tighter, and falls between 522 and 635. Thus, a greater percentage of compressors are quickly identified as being acceptable, and there are fewer inadvertent misidentifications of a compressor as being scrap. In addition, the test can be completed more quickly as it is not necessary to allow the prior art broad time range for the compressors to reach the test pressure.

The present invention achieves benefits in simplifying the assembly, and further in testing for quality of the compressor. Moreover, the present invention has operational benefits in that it supplies the fluid to the back pressure chamber more quickly thus resulting in the compressor reaching operative pressures more quickly.

Figure 6:
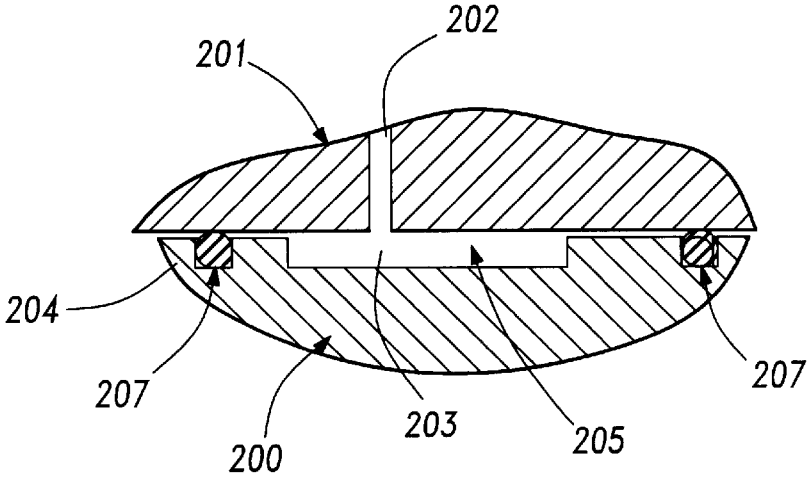
FIG. 6 shows a second embodiment according to the present invention.

FIG. 6 shows a second embodiment 200 where orbiting scroll 201 has hole 202 leading to a back pressure chamber 203 between orbiting scroll 201 and a crankcase 204. Seals 207 define the back pressure chamber 203. A recess 205 surrounds the axis of rotation of the compressor.

As known, the movement of the back pressure hole 202 during orbital movement of orbiting scroll 201 can be easily predicted, and defines an orbit diameter. By knowing the orbit diameter and the diameter of the back pressure hole, one can predict movement of the back pressure hole 202. Preferably, recess 205 is made wide enough such that the back pressure hole 202 is aligned with a portion of the recess 205 during the entire orbital cycle. In some applications, it may be possible that the recess 205 be made smaller, and at portions of the cycle the hole 202 may then still be blocked and not aligned with a portion of the recess. This will provide benefits when compared to the prior art, although it is believed these benefits will not be as pronounced as is the case when the hole 202 is constantly aligned with the recess 205.

Figure 7:
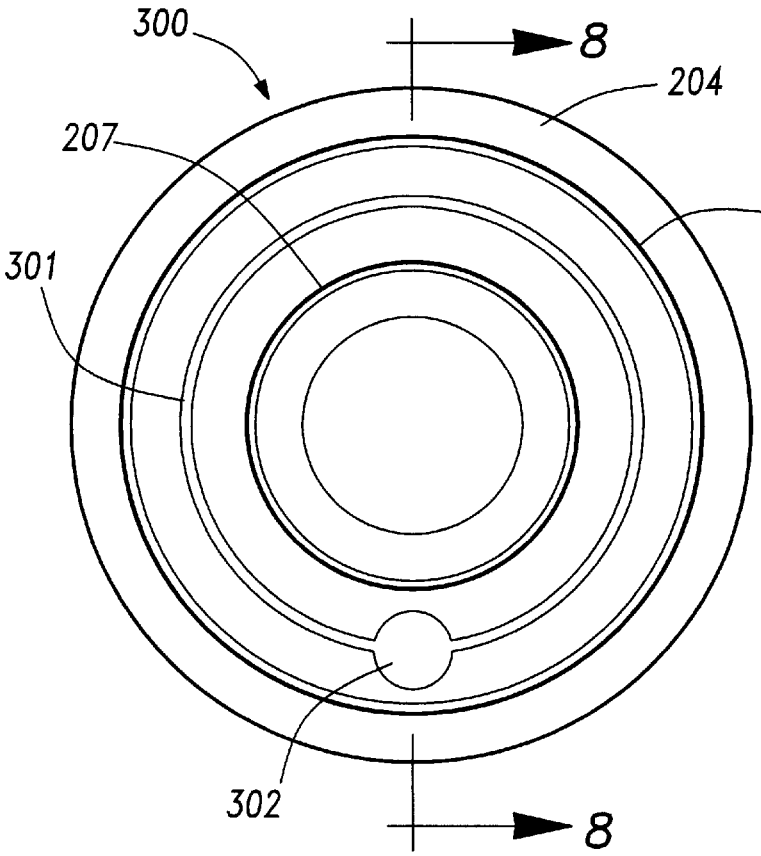
FIG. 7 shows a third embodiment according to the present invention.

FIG. 7 shows a third embodiment 300 which is somewhat similar to the embodiment 200. In embodiment 300 the recess 301 is generally a relatively thin circular portion. An enlarged relief 302 is generally circular and found at one circumferential location in the recess 301. Recess portion 302 is designed to cover the entire orbiting movement of the back pressure hole 202. Again, the movement of the back pressure hole 202 can be easily calculated. The third embodiment 300 simply ensures that during this entire movement the back pressure hole 202 is aligned with the recess 302.

Figure 8:
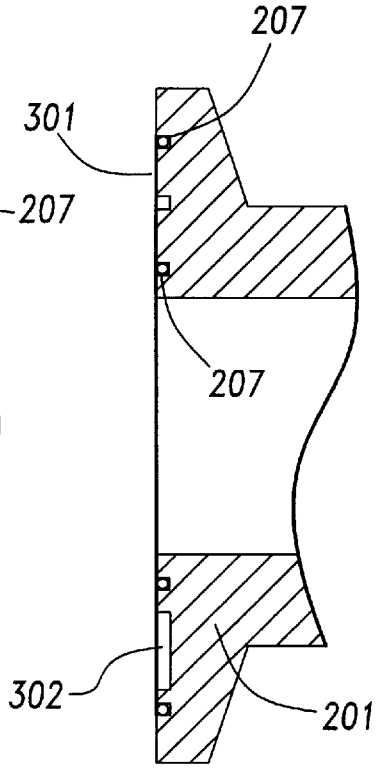
FIG. 8 is a cross-sectional view along line 8—8 as shown in FIG. 7.

In the FIGS. 6–8 embodiments, the depths of the recess is preferably maintained relatively small. In general, it is desirable to tightly contain the volume of the back pressure chamber 203, and thus not desirable to create an overly deep recess 205 or 301. In most cases the depth of the recess will be between 0.1 and 0.2 mm. These second and third embodiments are expected to achieve benefits similar to the first embodiment with regard to the compressor quickly reaching its design pressures.

Certain general comments would apply to the design of the recesses in this invention. First, the recesses in any one of the three embodiments cannot encroach into the seal areas. The recesses are generated by cutting tools which typically have a radius cutting tip. The radius may be anywhere from 0.5 to 3.0 mm. Thus, although shown as true squares, in practice the recesses may have curved edges. In general, it is desirable to minimize the volume of the recess, in that the recess volume adds to the volume of the total back pressure chamber, increasing the transient time for the back pressure chamber to reach its operational desired pressure. Finally, in the first embodiment, the groove cannot be so deep as to contact the crossing passage 27.

As is clear from the several embodiments, the recess has a flow cross sectional area which is greater than the flow cross sectional area of the back pressure tap. However, the flow cross section of the recess is still less than the cross sectional area of the back pressure chamber, which is defined between the inner and outer seals.

Preferred embodiments of this invention have been disclosed, however, a worker of ordinary skill in the art would recognize that certain modifications come within the scope of this invention. For that reason, the following claims should be studied to determine the true scope and content of this invention.

We claim:

1. A scroll compressor comprising:

a non-orbiting scroll having a base and a generally spiral wrap extending from said base;

an orbiting scroll having a base and a generally spiral wrap extending toward said non-orbiting scroll base from a front face of said orbiting scroll base, said orbiting scroll wrap interfitting with said non-orbiting scroll wrap to define compression chambers;

housings receiving said non-orbiting and said orbiting scrolls;

a back pressure tap extending through said base of one of said non-orbiting and orbiting scrolls to said front face of said base of said one scroll to tap fluid pressure, said tap communicating with a passage extending through said one scroll to a back pressure hole, said back pressure hole communicating with said passage and supplying fluid removed from said tap to a back pressure chamber defined between said one scroll and said housing; and a recess communicating with said back pressure hole and formed into a face of said one scroll and said housing, said recess having a flow cross-sectional area which is greater than the flow cross-sectional area of said back pressure hole, said recess being formed in a rear face of said base of one of said non-orbiting and said orbiting scrolls, said back pressure hole having a diameter, and a depth of said recess being less than said diameter of said back pressure hole.

2. A scroll compressor as recited in claim 1, wherein the depth of said recess is less than 0.5 mm.

3. A scroll compressor as recited in claim 1, wherein sides of said recess are angled outwardly to merge into said rear face of said orbiting scroll base.

4. A scroll compressor as recited in claim 1, wherein said recess surrounds an axis of said orbiting scroll.

5. A scroll compressor as recited in claim 1, wherein said recess has a depth that is less than 0.5 mm.

6. A scroll compressor as recited in claim 1, wherein said recess being formed in said base of said orbiting scroll, and said recess surrounds a central axis of said orbiting scroll.

7. A scroll compressor as recited in claim 6, wherein said recess is generally circular.

8. A scroll compressor comprising:

a non-orbiting scroll having a base and a generally spiral wrap extending from said base;

an orbiting scroll having a base and a generally spiral wrap extending toward said non-orbiting scroll base from a front face of said orbiting scroll base, said orbiting scroll wrap intermitting with said non-orbiting scroll wrap to define compression chambers;

a crankcase receiving said orbiting scroll;

a back pressure tap extending through said base of said orbiting scroll to said front face of said base of said orbiting scroll to tap fluid pressure, said tap communicating with a passage extending through said orbiting scroll to a back pressure hole, said back pressure hole communicating with said passage and supplying fluid removed from said tap to a back pressure chamber defined between said orbiting scroll and said crankcase; and a recess communicating with said back pressure hole, and formed in a rear face of said orbiting scroll, said recess being generally circular and surrounding a central axis of said orbiting scroll, said back pressure hole having a diameter, and a depth of said recess into said rear face being less than said diameter of said back pressure hole.

9. A scroll compressor as recited in claim 8, wherein said depth of said recess is less than 0.5 mm.

10. A scroll compressor as recited in claim 9, wherein sides of said recess are angled outwardly to merge into said rear face of said base.

11. A scroll compressor comprising:

a non-orbiting scroll having a base and a generally spiral wrap extending from said base;

an orbiting scroll having a base and a generally spiral wrap extending toward said non-orbiting scroll base from a front face of said orbiting scroll base, said orbiting scroll wrap interfitting with said non-orbiting scroll wrap to define compression chambers;

a crankcase receiving said orbiting scroll;

a back pressure tap extending through said base of said orbiting scroll to said front face of said base of said orbiting scroll to tap fluid pressure, said tap communicating with a passage extending through said orbiting scroll to a back pressure hole, said back pressure hole communicating with said passage and supplying fluid removed from said tap to a back pressure chamber defined between said orbiting scroll and said crankcase; and a recess communicating with said back pressure hole, and formed into a face of said orbiting scroll, said recess having a flow cross-sectional area which is greater than the flow cross-sectional area of said back pressure hole, said recess surrounding an axis of said orbiting scroll, said recess extending into said orbiting scroll for a depth, said back pressure hole having a diameter, said diameter being greater than said depth, said recess being formed in a rear face of said orbiting scroll base.

12. A scroll compressor as recited in claim 11, wherein said recess is formed in a rear face of said orbiting scroll base.

13. A scroll compressor as recited in claim 11, wherein said recess is formed in said crankcase.

14. A scroll compressor as recited in claim 11, wherein said recess is generally circular.

15. A scroll compressor comprising:

a first scroll having a base and a generally spiral wrap extending from said base;

a second scroll having a base and a generally spiral wrap extending toward said first scroll base from a front face of said second scroll base, said second scroll interfitting with said first scroll wrap to define compression chambers, said second scroll orbiting relative to said first scroll;

a housing associated with each of said scrolls, one housing received on an opposed side of said base of said second scroll from said first scroll and a housing received on an opposed side of said base of said first scroll from said second scroll;

a back pressure tap extending through said base of one of said first and said second scrolls to a front face of said base to tap fluid pressure from one of said compression chambers, said tap communicating to a back pressure chamber defined between said base of said one scroll and said housing, said back pressure chamber also being defined by inner and outer seal surfaces, and said back pressure chamber defining a first cross sectional area between said inner and outer seal surfaces; and a recess communicating with both said back pressure hole and said back pressure chamber, and formed into a face of one of said one scroll, and said housing associated with said one scroll, said recess having a second cross sectional area which is greater than a third flow cross sectional area of said back pressure hole, but substantially smaller than said first area.

16. A scroll compressor as recited in claim 15, wherein said back pressure hole has a diameter, and a depth of said recess is less than said diameter of said hole.

17. A scroll compressor as recited in claim 15, wherein said recess is formed in said crankcase.

18. A scroll compressor as recited in claim 17, wherein said recess surrounds the axis of said orbiting scroll, and is configured such that said back pressure hole will be aligned with said recess throughout a cycle of operation of the compressor.

19. A scroll compressor as recited in claim 18, wherein said recess includes a relatively thin circular portion having a relatively enlarged portion at one circumferential location, said enlarged portion being designed to cover the entire area through which said back pressure hole will face during the operational cycle of the compressor.

* * * * *